US008400080B2

(12) United States Patent
Tan et al.

(10) Patent No.: US 8,400,080 B2
(45) Date of Patent: Mar. 19, 2013

(54) PULSE WIDTH MODULATION (PWM) CLOSED LOOP LED CURRENT DRIVER IN AN EMBEDDED SYSTEM

(75) Inventors: Li-Quan Tan, Sunnyvale, CA (US); Wing Kong Low, Cupertino, CA (US); Thai La, San Jose, CA (US)

(73) Assignee: Apple Inc., Cupertino, CA (US)

( * ) Notice: Subject to any disclaimer, the term of this patent is extended or adjusted under 35 U.S.C. 154(b) by 97 days.

(21) Appl. No.: 13/171,161

(22) Filed: Jun. 28, 2011

(65) Prior Publication Data

US 2011/0254464 A1 Oct. 20, 2011

Related U.S. Application Data

(63) Continuation of application No. 12/478,611, filed on Jun. 4, 2009, now Pat. No. 7,994,730.

(51) Int. Cl.

| | |
|---|---|
| ***G05F 1/00*** | (2006.01) |
| ***H05B 37/02*** | (2006.01) |
| ***H05B 39/04*** | (2006.01) |
| ***H05B 41/36*** | (2006.01) |

(52) U.S. Cl. ..... 315/307; 315/291; 315/302; 315/308

(58) Field of Classification Search ..... None
See application file for complete search history.

(56) References Cited

U.S. PATENT DOCUMENTS

| | | | | |
|---|---|---|---|---|
| 6,400,101 | B1 * | 6/2002 | Biebl et al. | 315/291 |
| 6,586,890 | B2 | 7/2003 | Min et al. | |
| 6,621,235 | B2 | 9/2003 | Chang | |
| 7,276,863 | B2 | 10/2007 | Lee et al. | |
| 7,378,805 | B2 | 5/2008 | Oh et al. | |
| 7,402,961 | B2 | 7/2008 | Bayat et al. | |
| 7,570,235 | B2 * | 8/2009 | Shaanan et al. | 345/82 |
| 8,203,281 | B2 * | 6/2012 | Cegnar et al. | 315/291 |
| 2007/0001625 | A1 | 1/2007 | Kim | |
| 2009/0102399 | A1 | 4/2009 | Kita | |
| 2010/0176734 | A1 | 7/2010 | Haubmann | |

OTHER PUBLICATIONS

Anonymous, "Vf Monitoring Circuit Improves System Efficiency for LED Backlighting in Monitor and TV Applications," IP.com No. IPCOM000162000D, Dec. 12, 2007.

* cited by examiner

*Primary Examiner* — Anh Tran
(74) *Attorney, Agent, or Firm* — Womble Carlyle Sandridge & Rice LLP

(57) ABSTRACT

Methods and systems for providing stable and accurate low noise DC reference voltage are described. In the described embodiments, a feedback controlled DC reference voltage supply provides a stable and well controlled sense current. The sense current is in turn used to produce a stable and well controlled light output from a light emitting diode (LED).

22 Claims, 7 Drawing Sheets baseline current $I_c$ tuned by modifying $V_{nominal}$ by $\Delta V$

PULSE WIDTH MODULATION (PWM) CLOSED LOOP LED CURRENT DRIVER IN AN EMBEDDED SYSTEM

CROSS REFERENCE TO RELATED APPLICATIONS

This application is a continuation of co-pending U.S. patent application Ser. No. 12/478,611, entitled "PULSE WIDTH MODULATION (PWM) CLOSED LOOP LED CURRENT DRIVER IN AN EMBEDDED SYSTEM," filed Jun. 4, 2009, which is hereby incorporated by reference herein.

BACKGROUND OF THE INVENTION

1. Field of the Invention

This invention relates generally to LED circuits and in particular, providing an LED having a stable, highly accurate light output.

2. Description of the Related Art

FIG. 1 shows conventional light emitting diode (LED) circuit 100. LED circuit 100 includes at least light emitting diode 102, bipolar NPN transistor 104, sense resistor $R_{sense}$, and external reference voltage $V_{REF}$. Light output LO of LED 102 is related to LED current $I_{LED}$ which, in turn, is an exponential function of diode voltage $V_D$ according to eq (1) below:

$$I_{LED}=I_S e^{V_D(nVT)} \quad \text{Eq (1)}$$

where:

$I_S$ is the reverse bias saturation current, $V_D$ is the voltage across the diode, $V_T$ is the thermal voltage, and n is the emission coefficient.

Due to the exponential relationship between LED current $I_{LED}$ and diode voltage $V_D$, a small change in diode voltage $V_D$ can result in a large change in LED current $I_{LED}$ and light output LO. Since there is essentially no base current (save for base leakage current which can for all purposes be ignored) in NPN transistor 104, $I_{LED}$ has essentially the same value as the current that flows through sense resistor $R_{sense}$ according to eq (2) below:

$$I_{LED}\cong(V_{REF}-V_{BE})/R_{sense} \quad \text{Eq (2)}$$

Therefore, by using $R_{sense}$ to control $I_{LED}$, circuit 100 does not rely upon the exponential relationship between diode voltage $V_D$ and $I_{LED}$ (i.e., Eq (1)) to control light output LO but rather the linear relationship between $I_{LED}$ and $R_{sense}$ (i.e., Eq (2)) since $R_{sense}$ can easily be controlled to within <±1% with commonly available parts. However, $V_{SENSE}$ ($V_{REF}-V_{BE}$) is clearly dependent upon $V_{REF}$ and $V_{BE}$ and a dedicated external voltage reference can provide an accurate $V_{REF}$ having approximately ±3% regulation. However using the dedicated external voltage supply typically adds significant cost (that can be up to 2-4 times the cost of the LED itself). Thus to save cost, often, external voltage reference $V_{REF}$ is sourced at an digital output of a micro-controller. However, the associated variation in DC output voltage can be on the order of +/−10%. Compounding the variability of the reference voltage supply $V_{REF}$, NPN transistor 104 base emitter voltage $V_{BE}$ can have a part to part variance of about ±7%. All these variations taken together can result in substantial variability and inaccuracy of $V_{sense}$ and thus the $I_{LED}$ (and light output LO). For example, using the topology of circuit 100, the overall accuracy in controlling $I_{LED}$ (and light output LO) with a dedicated external $V_{REF}$ of approximately 1.5 volts and $V_{DD}$ of approximately 3.3 V can be on the order of approximately ±20% for a desired current of 25 mA. This variability in $I_{LED}$ (and light output LO) can result in unacceptable variation in visual appearance of components that include these LEDs.

Another consideration is related to the use of LEDs in portable applications, such as laptop computers, where power consumption can be crucial to providing good battery life. In order to reduce overall power consumption, supply voltages have been trending down from, for example, 5.0 volts to 3.3 volts and lower. Therefore, it would be advantageous for $V_{sense}$ to be as small a value as possible in order to minimize the required supply voltage according to equation (3A). Minimizing $V_{sense}$ is also desirable to reduce the power $P_c$ consumed (and wasted) by current $I_{LED}$ flowing through sense resistor $R_{sense}$ according to Eq (3B):

$$V_{supply}=V_{sense}+Vi_{ce}+V_{LED} \quad \text{Eq (3A)}$$

$$P_c=I_{LED}\times V_{sense}I_{sense}\times V_{sense} \quad \text{Eq (3B)}$$

In order to achieve the minimal Vsense, Vref must be precisely set at a value according to Eq (4). From the equation, a typical Vref would be <1V. Dedicated external voltage reference capable of providing such low voltage is uncommon.

$$V_{ref}=V_{be}+V_{sense} \quad \text{Eq (4)}$$

Therefore, providing a cost effective approach to providing a stable, precise, and accurate reference voltage in a low supply voltage environment is desired.

SUMMARY OF THE DESCRIBED EMBODIMENTS

The invention relates to light emitting diodes (LED). In particular, circuits, systems, and method for providing an LED having a stable and highly accurate light output.

In one embodiment, a method for providing an internally generated low noise reference DC voltage in a system is described. The system includes at least an analog to digital converter (ADC) circuit connected to a logic circuit that in turn is connected to a pulse width modulator (PWM) unit. The PWM unit is connected to a filtering circuit arranged to provide a DC voltage based upon a PWM output signal. The method can be carried out by performing at least the following operations, providing a sensed voltage at an input of the ADC that converts the sensed voltage to a digital signal. The logic circuit processes the digital signal to determine if the sensed voltage is within an acceptable range of voltage values. If the sensed voltage is not within the acceptable range, then the logic circuit provides a PWM duty cycle altering feedback signal to the PWM unit that responds by altering the duty cycle of the PWM output signal. The filtering circuit provides an altered DC reference voltage based upon the altered duty cycle PWM output signal. The sensed voltage is then updated to reflected the altered DC reference voltage. The process is repeated until it is determined that the sense voltage is within the acceptable range of values.

If the sensed voltage is above the acceptable range, then the feedback signal causes the duty cycle of the PWM unit to be reduced. The filter circuit responds by reducing the DC reference voltage. On the other hand, if the sensed voltage is determined to be below the acceptable range, then the feedback signal causes the duty cycle of the PWM unit to be increased. The filter circuit responds by increasing the DC reference voltage until the sensed voltage is determined to be within the acceptable range.

In one aspect of the described embodiments, the output of the filter circuit is connected to a base node of an NPN transistor at a DC reference voltage, the NPN transistor having at least one emitter at a sense voltage related to the DC reference voltage. The at least one emitter is, in turn, connected to the input node of the ADC a first node of a sense resistor having a second node connected to ground. Any variations in base to emitter voltage ($V_{BE}$) of the NPN transistor can be input to the ADC as the sensed voltage. If any variation of $V_{BE}$ causes the sensed voltage to be out of the acceptable range (i.e., the range of voltages represented between an upper threshold value and a lower threshold value), then the logic circuit provides the appropriate feedback signal to the PWM unit. In this way, the feedback between $V_{BE}$ and DC reference voltage has the effect of mitigating or even eliminating the adverse effects caused by the variability of $V_{BE}$ and thereby increasing the stability and accuracy of current through the sense resistor.

An apparatus is described that includes at least an analog to digital converter (ADC) arranged to convert an analog voltage signal to a corresponding digital signal, a feedback circuit arranged to receive and process the digital signal, a pulse width modulation unit (PWM) arranged to provide a modulated signal at a first duty cycle, and a filtering circuit arranged to provide a reference DC voltage based upon the modulated signal at the first duty cycle. If the analog signal is determined by the feedback circuit to not be within an acceptable range of analog voltage values, then the feedback circuit generates a feedback signal and sends the feedback signal to the to the PWM unit. The PWM unit in turn responds to the feedback signal by altering the duty cycle of the modulated signal that causes the filtering circuit to modify the DC reference voltage based upon the altered duty cycle modulated signal. The modified DC reference voltage updates the analog voltage signal. The feedback continues until the analog signal is determined to be within the range of acceptable voltage values.

A light emitting diode (LED) driver circuit is described that includes at least the following components. An LED having a first node connected to $V_{dd}$, an NPN bipolar transistor having a base node, at least one emitter node, and a collector node being connected to a second node of the LED, an analog to digital converter (ADC) having an input node connected to the at least one emitter node arranged to convert a sense voltage at the input node to a corresponding digital signal at an ADC output node, a sense resistor having a first node at the sense voltage connected to the at least one emitter node and a second node connected to ground where a current passing through the LED is substantially equal to a current flowing through the sense resistor biased at the sense voltage. The driver circuit also includes a logic circuit connected to an output node of the ADC, wherein the logic circuit includes logical elements arranged to process the digital signal a pulse width modulator (PWM) connected to the logic circuit arranged to generate a modulated digital signal at a first duty cycle at a PWM output node. When the logic circuit determines if the sense voltage is not within a range of acceptable voltage values, the logic circuit generates a PWM duty cycle altering feedback signal. A filtering circuit connected to the PWM output node provides a DC reference voltage to the base node of the NPN transistor by filtering the PWM output signal at the first duty cycle. The PWM unit responds to the duty cycle altering feedback signal by commensurably altering the duty cycle of the PWM output signal that causes the filtering circuit to update the DC reference voltage applied to the base node of the NPN transistor having a mitigating effect on the sense voltage at the at least one emitter node of the NPN transistor.

In another embodiment, a computer readable medium including at least computer program code for providing a low noise reference DC voltage in a system is disclosed. The system includes at least an analog to digital converter (ADC) circuit connected to a logic circuit, the logic circuit being connected to a pulse width modulator (PWM) connected to a filtering circuit arranged to provide the low noise DC reference voltage based upon a PWM output signal. The computer readable medium includes at least computer program code for providing a sensed voltage at an input of the ADC, computer program code for converting the sensed voltage to a digital signal, computer program code for processing the digital signal by the logic circuit to determine if the sensed voltage is within an acceptable range of voltage values wherein if the sensed voltage is not within the acceptable range, then providing a PWM duty cycle altering feedback signal to the PWM unit, computer program code for altering the DC reference voltage based upon the altered duty cycle PWM output signal, and computer program code for updating the sensed voltage based upon the altered DC reference voltage until the sensed voltage is determined to be within the acceptable range of voltage values.

In another embodiment, a tunable current source can be provided by modifying the logic by which the digital signal is processed. For example, if a nominally acceptable sense voltage value is increased/decreased by, for example $\pm\Delta V$ (and assuming the upper and lower threshold values are also changed), then the sense voltage will also change according to the change in the sense voltage nominal value. The change is sense voltage will in turn modify the amount of current generated by the tunable current source in direct proportion to the resistor $R_{sense}$.

DETAILED DESCRIPTION OF SELECTED EMBODIMENTS

Figure 1:
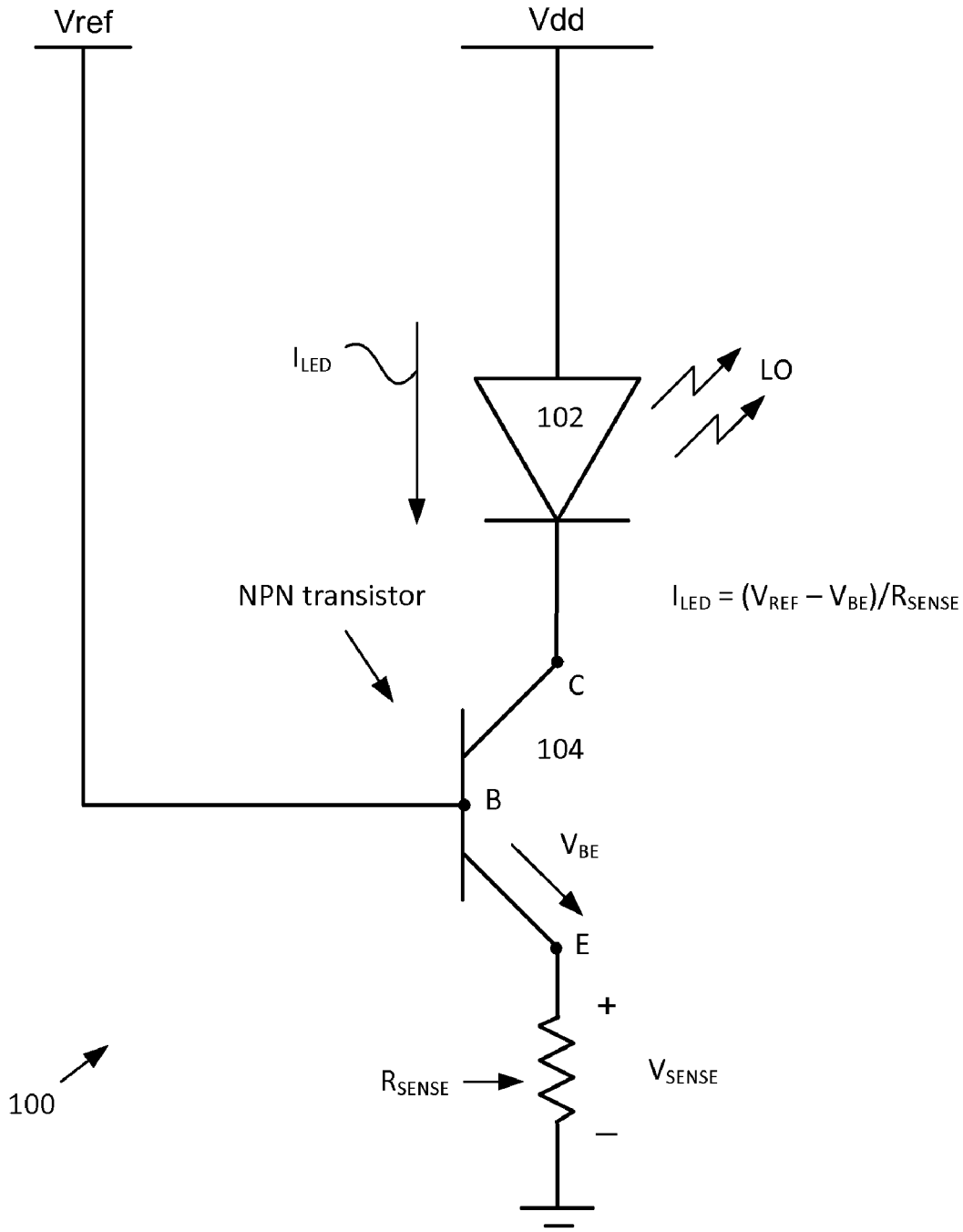
Fig. 1 Prior Art
FIG. 1 shows a conventional light emitting diode (LED) circuit.

Reference will now be made in detail to selected embodiments an example of which is illustrated in the accompanying drawings. While the invention will be described in conjunction with a preferred embodiment, it will be understood that it is not intended to limit the invention to one preferred embodiment. To the contrary, it is intended to cover alternatives, modifications, and equivalents as can be included within the spirit and scope of the invention as defined by the appended claims.

The described embodiments relate to a system, method and apparatus suitable for providing a stable, accurate, and cost effective reference DC voltage supply useful in low supply voltage environments such as laptop computers, portable battery powered devices such as portable media players and cell phones, etc. A particularly useful aspect of the embodiments is that the techniques described herein can be used to mitigate the effects of the natural variability found in many natural and manufactured electrical components. For example, light emitting diodes (LEDs) produce a light output that is exponentially related to a voltage drop across the LED (referred to as the diode voltage $V_D$). Therefore using diode voltage $V_D$ to control the light output of the LED is not particularly practical since any small variation in diode voltage $V_D$ can result in a large variation in light output. Accordingly, it has become common practice to use the current through the diode (referred to as $I_{LED}$) to control the light output of the LED. Therefore the light output of the LED can be controlled simply by controlling LED current $I_{LED}$. Moreover, the described DC voltage reference is highly precise since the output voltage can be adjusted, or tuned, at intervals of about 20 mV as compared to conventional voltage supplies requiring at least 100 mV between set points.

In one embodiment, in order to carefully control the diode current $I_{LED}$, an LED driver circuit is provided that uses a feedback loop to maintain a sense voltage to within an acceptable range of voltage values. In the described embodiments, the sense voltage is directly related to and positively correlated with an internally provided DC reference voltage. The sense voltage is in turn used to bias a sense resistor generating $L_{sense}$ that is substantially equal to $I_{LED}$. In order to well control $I_{LED}$, the sense voltage is converted to a corresponding digital signal. The digital signal is then logically processed to determine if the sense voltage is within the acceptable range of sense voltages. A feedback signal is provided when the sense voltage is not within the acceptable range of voltage values to the internally provided DC reference voltage generator. The feedback signal has the effect of reducing the DC reference voltage when the sense voltage is above an upper threshold and to increase the DC reference voltage when the sense voltage is less than a lower threshold. Since the sense voltage and the internally provided DC reference voltage are directly related and positively correlated, then the change in DC reference voltage has the effect of mitigating the out of range sense voltage until the sense voltage is within the acceptable range of voltages.

In another embodiment, a tunable current source can be provided by modifying the logic by which the digital signal is processed. For example, if a nominally acceptable sense voltage value is increased/decreased by, for example $\pm\Delta V$ (and assuming the upper and lower threshold values are also changed), then the sense voltage will also change according to the change in the sense voltage nominal value. The change is sense voltage will in turn modify the amount of current generated by the tunable current source in direct proportion to the resistor $R_{sense}$.

Figure 2:
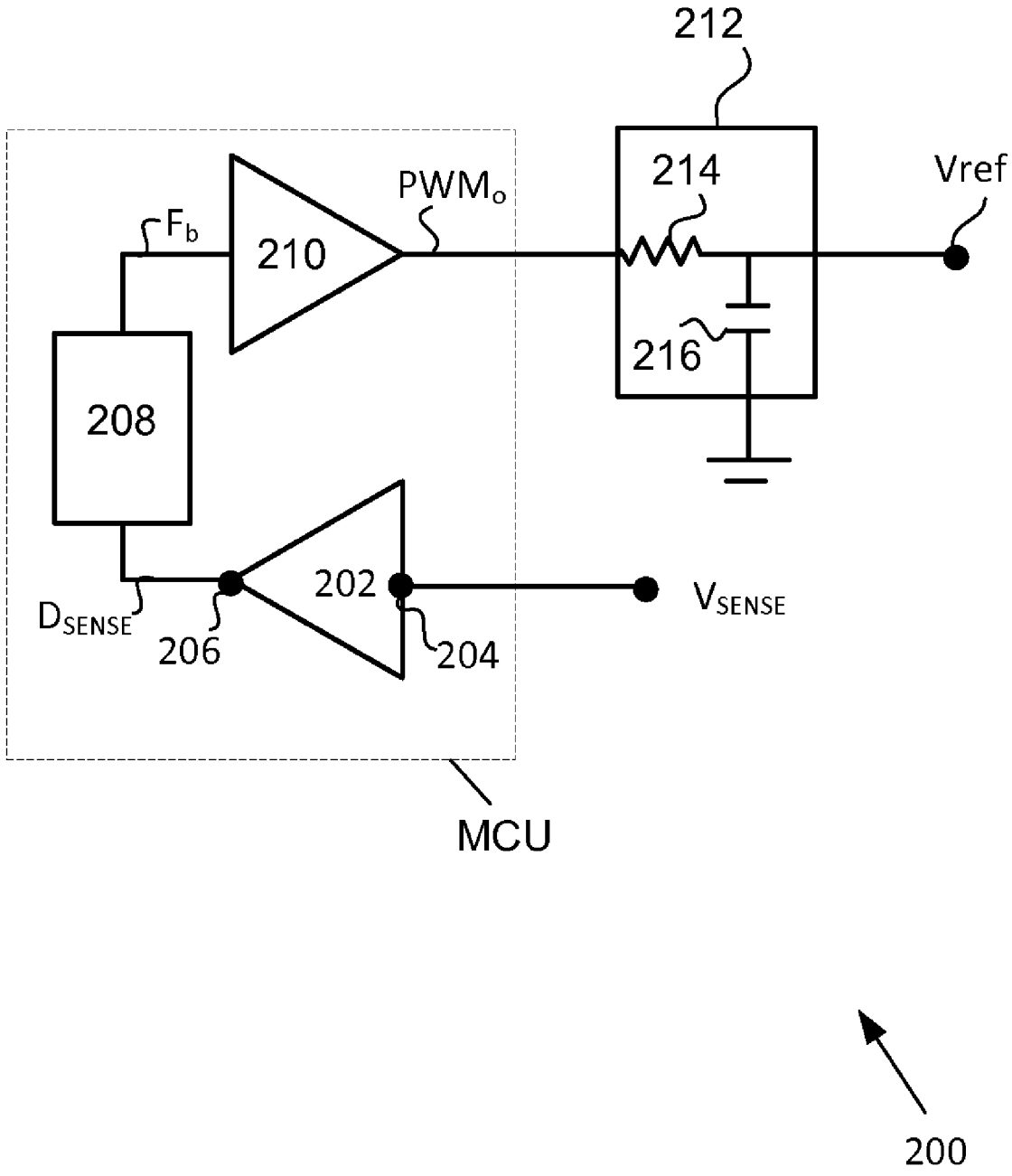
FIG. 2 shows system for providing a stable and accurate reference voltage in accordance with the described embodiments.

FIG. 2 shows system 200 for providing a stable and accurate reference voltage in accordance with the described embodiments. System 200 includes at least analog to digital converter (ADC) circuit 202 having input node 204 and output node 206 connected to logic circuit 208. Logic circuit 208 can be connected to pulse width modulator (PWM unit) 210. PWM unit 210 can be connected to filtering circuit 212. Filtering circuit 212 can be used to provide reference voltage $V_{REF}$ by filtering the output of PWM unit 212. In one configuration, filtering circuit 212 be a low pass filtering circuit having capacitor 216 and resistor 214.

Providing (analog) sensed voltage $V_{sense}$ at input node of ADC circuit 202 causes ADC circuit 202 to convert sensed voltage $V_{sense}$ to corresponding digital signal $D_{sense}$ at output node 206. Digital signal $D_{sense}$ is then provided to logic circuit 208 for processing. In the described embodiment, logic circuit 208 includes firmware or other logic elements well known in the art to process digital signal $D_{sense}$ based upon a pre-determined logical expression or equation. For example, if digital signal $D_{sense}$ is logically processed by logic circuit 208 to indicate that sense voltage $V_{sense}$ is not within an acceptable range of values, then logic circuit 208 can provide feedback signal $F_b$ to PWM unit 210, otherwise, no feedback signal is provided.

When the logical processing of $D_{sense}$ indicates that sensed voltage $V_{sense}$ is not within the acceptable range of values, then logic circuit can determine if sensed voltage $V_{sense}$ is above upper threshold value $V_{upper}$ or below a lower threshold value $V_{lower}$. In the case where sense voltage $V_{sense}$ is determined to be above upper threshold value $V_{upper}$, logic circuit 208 provides first feedback signal $F_{b1}$ to PWM unit 210. First feedback signal $F_{b1}$ can cause PWM unit 210 to reduce the duty cycle of output signal $PWM_{signal}$. On the other hand, when sense voltage $V_{sense}$ is determined to be below lower threshold value $V_{lower}$, logic circuit 208 provides second feedback signal $F_{b2}$ to PWM unit 210 causing PWM unit 210 to increase the duty cycle of output signal $PWM_{signal}$ resulting in a modification of DC reference voltage $V_{REF}$.

Filtering circuit 210 receives and processes output signal $PWM_o$ to provide reference voltage $V_{REF}$. When the duty cycle of output signal $PWM_o$ is increased, the value of reference voltage $V_{REF}$ also increases, and vice versa. Therefore, any variation of sense voltage $V_{sense}$ that causes $V_{sense}$ to fall out of an acceptable range of sense voltage values can be mitigated by feedback signal $F_b$ provided by logic circuit 208 appropriately modifying the duty cycle of PWM unit 210.

Figure 3:
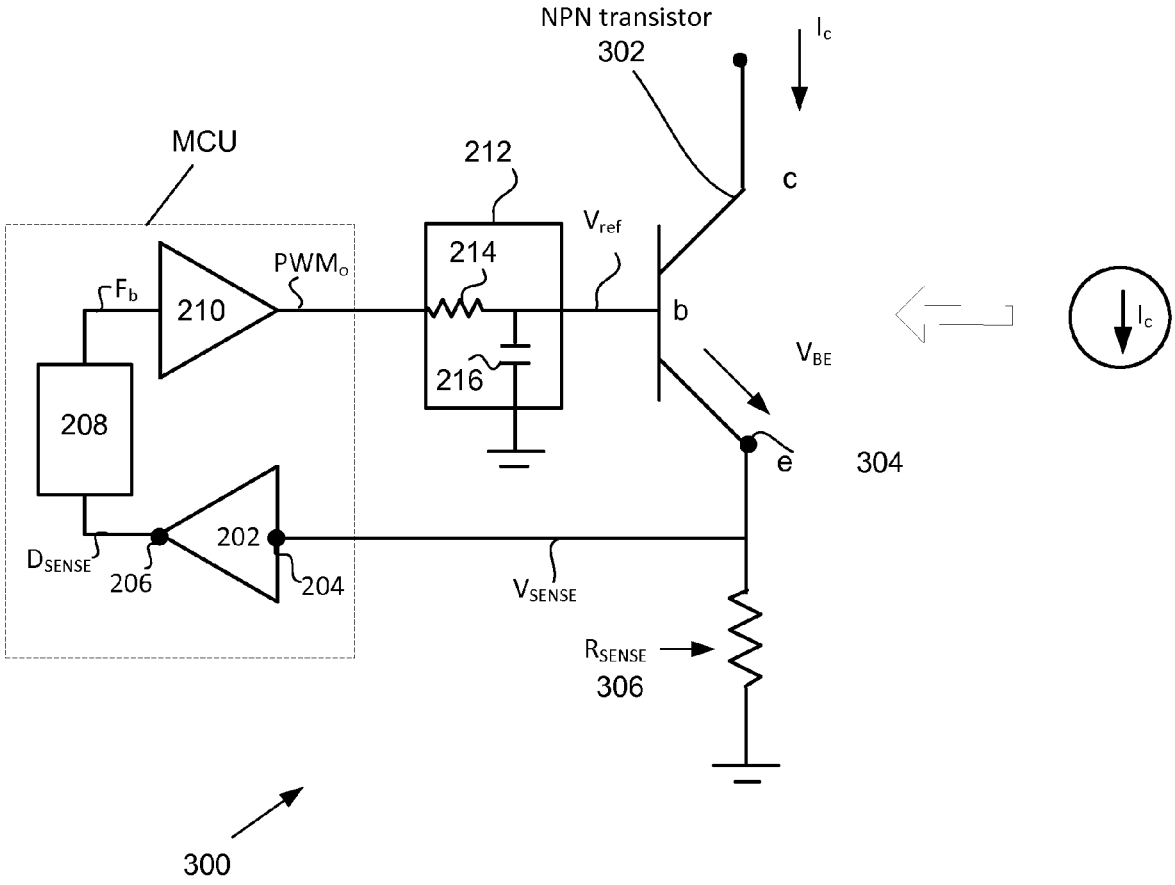
FIG. 3 shows an embodiment whereby the system of FIG. 2 can be used to provide a current source.
Figure 4:
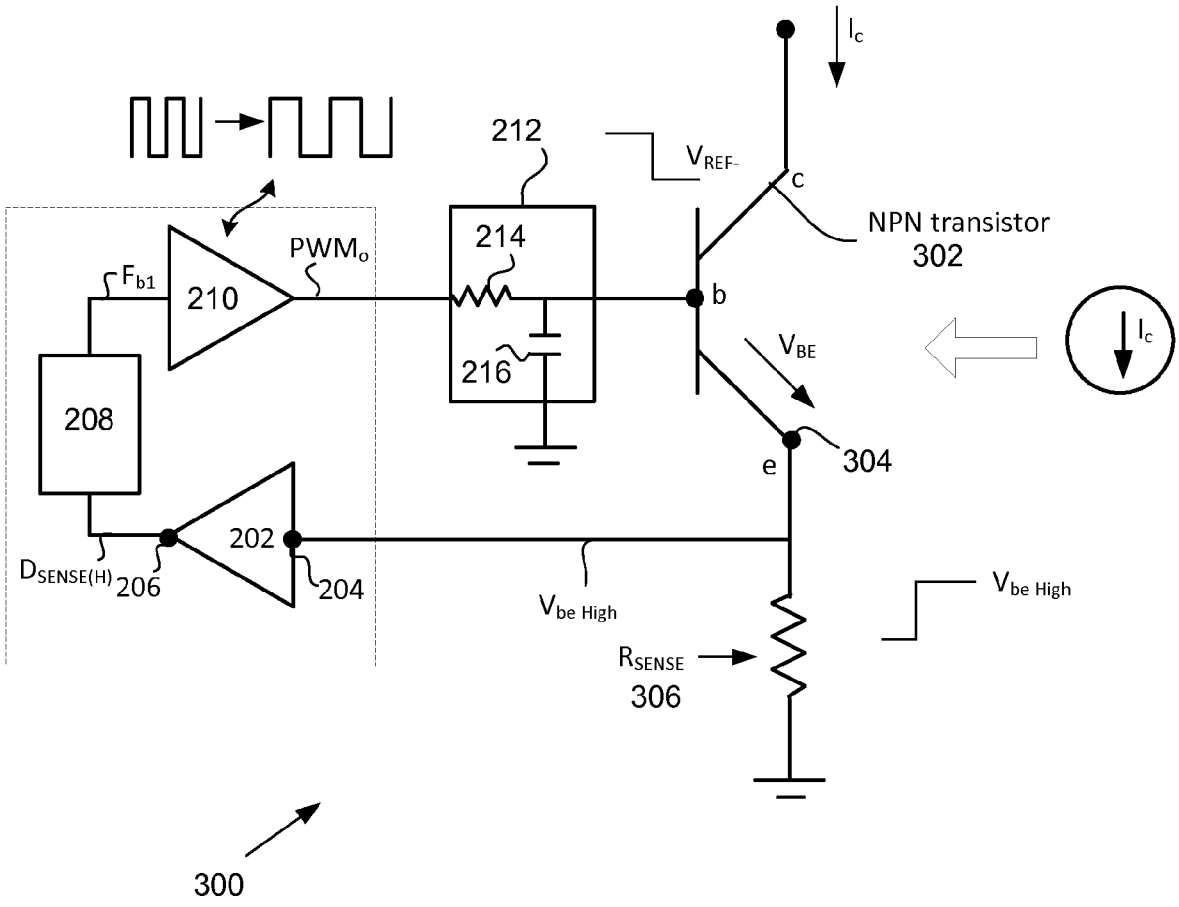
FIG. 4 shows the embodiment of FIG. 3 in operation to provide the current source.

System 200 can be used to provide a stable and accurate current source $I_c$ using circuit 300 shown in FIG. 3. As shown, circuit 300 includes NPN transistor 302 having at least one emitter 304 that can be connected to input node 204 of the ADC 202 and a first node of sense resistor 306 having a second node connected to ground. Any variations in base to emitter voltage ($V_{BE}$) of NPN transistor 302 can be passed to input 204 of ADC 202 as the sensed voltage $V_{sense}$. If a variation of $V_{BE}$ causes sensed voltage $V_{sense}$ to be out of the acceptable range (i.e., the range of voltages represented between an upper threshold value and a lower threshold value), then logic circuit 208 provides the appropriate feedback signal to the PWM unit 210 having the effect of reducing the variability of $V_{BE}$ (i.e., $V_{sense}$) and increasing the stability and accuracy of current $I_{sense}$ through sense resistor 306 (it should be noted that $Ic \cong I_{sense}$). For example, if as shown in FIG. 4, $V_{BE}$ increases from nominal $VBE_{nom}$ to $VBE_{HIGH}$, then ADC 202 converts analog voltage signal $VBE_{HIGH}$ to corresponding digital signal $D_{sense(H)}$. Logic circuit 208, in turn, determines if $D_{sense(H)}$ corresponds to analog voltage signal $VBE_{HIGH}$ being outside of the acceptable range of voltage values. Assuming for this example, that $VBE_{HIGH}$ is greater than upper threshold value, then logic circuit 208 provides first feedback signal Fb1 to PWM unit 210. PWM unit 210 responds to first feedback signal $F_{b1}$ by reducing the duty cycle of output signal $PWM_o$. Filtering circuit 212, in turn, low pass filters the reduced duty cycle output signal $PWM_o$ resulting in a reduced value of $V_{REF-}$. In the described embodiment, reduced value $V_{REF-}$ is applied to base node of transistor 204 as $V_b$. If transistor 204 is a NPN bipolar transistor, then emitter voltage $V_e$ (i.e., $V_{sense}$) is approximately $V_t$ volts (or approximately 0.6-0.7 volts) below $V_b$. In this case, $VBE_{HIGH}$ is reduced commensurate with the reduction in $V_{REF-}$ and the process continues until no further feedback is needed (i.e., within acceptable range of values).

Figure 5:
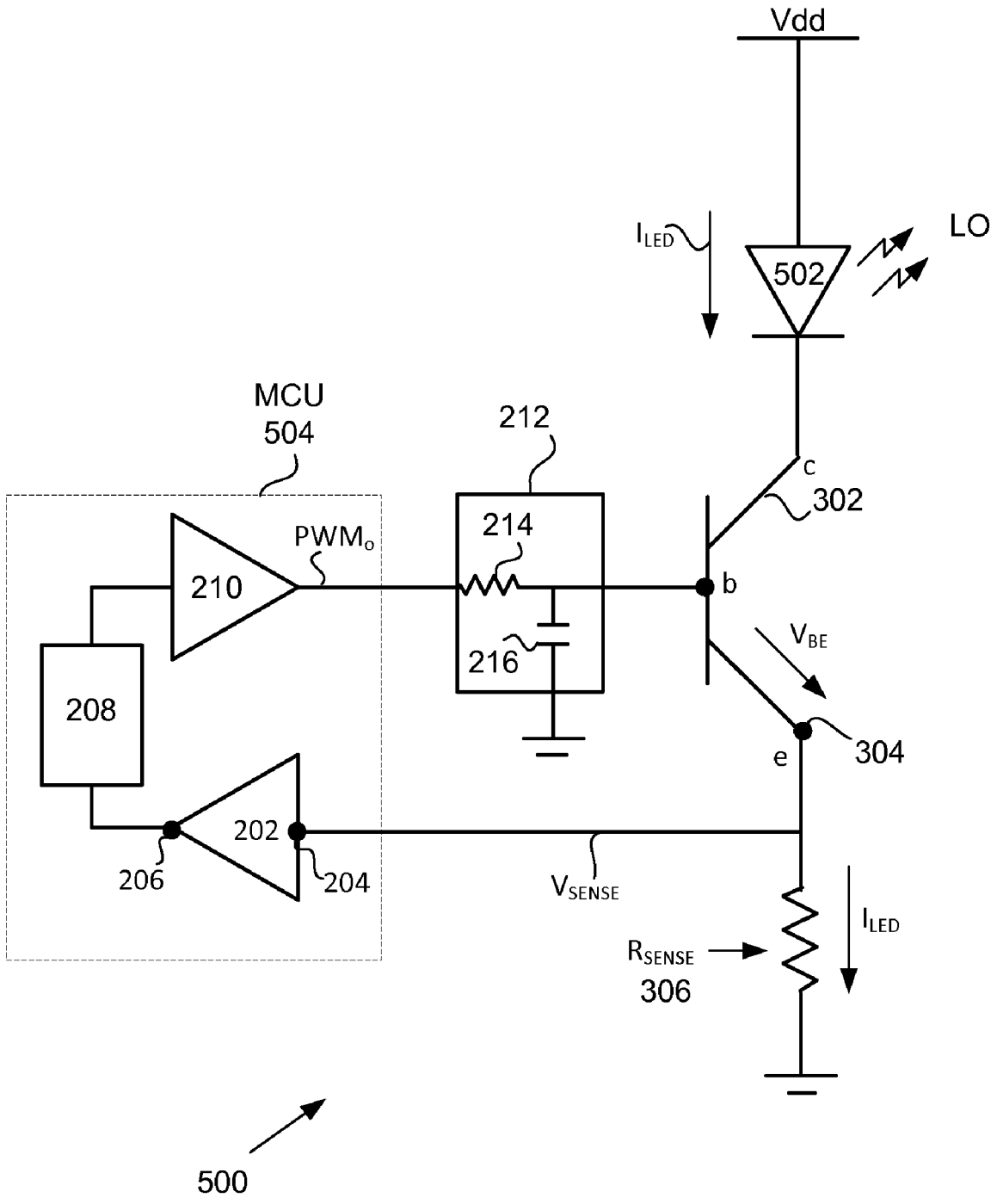
FIG. 5 shows a LED driver circuit in accordance with the described embodiments.

In a particularly useful embodiment, the stable and accurate current source $I_c$ describe in FIG. 3 can be used as part of LED driver circuit 500 used to provide the diode current $I_{LED}$ through LED 502 as illustrated in FIG. 5. As shown, LED 502 can have a first node connected to $V_{dd}$ and a second node connected to a collector node C of NPN transistor 302. In this configuration, $I_{LED}$ is essentially the same current $I_{sense}$ that flows through sense resistor $D_{sense}$ as eq (5):

$$I_{LED} \cong (V'_{REF} - V_{BE})/R_{sense} \quad \text{eq (5)}$$

where $V'_{REF}$ is feedback controlled. In this way, LED driver circuit 500 provides for stable and well controlled light output from LED 502. This is particularly useful in those situations where a highly reproducible light source is desired especially in those circumstances where intrinsic light output can vary from part to part.

In LED driver circuit 500 can be part of a system having a multiprocessor control unit (MCU) 504 that typically can include circuitry that can at least perform functions equivalent to those provided by ADC 202, and/or logic circuit 208, and/or PWM unit 210. In this way, no additional component costs need by incurred thereby reducing or essentially eliminating additional component costs. In some cases, it may be desirable to calibrate ADC 202 during either the manufacturing or outgoing quality process. For example, during a calibration process a known calibration voltage ($V_{cal}$) can be applied to input 204 of ADC 202 and any variation can be accounted for by programming an appropriate offset value into ADC 202.

Figure 6:
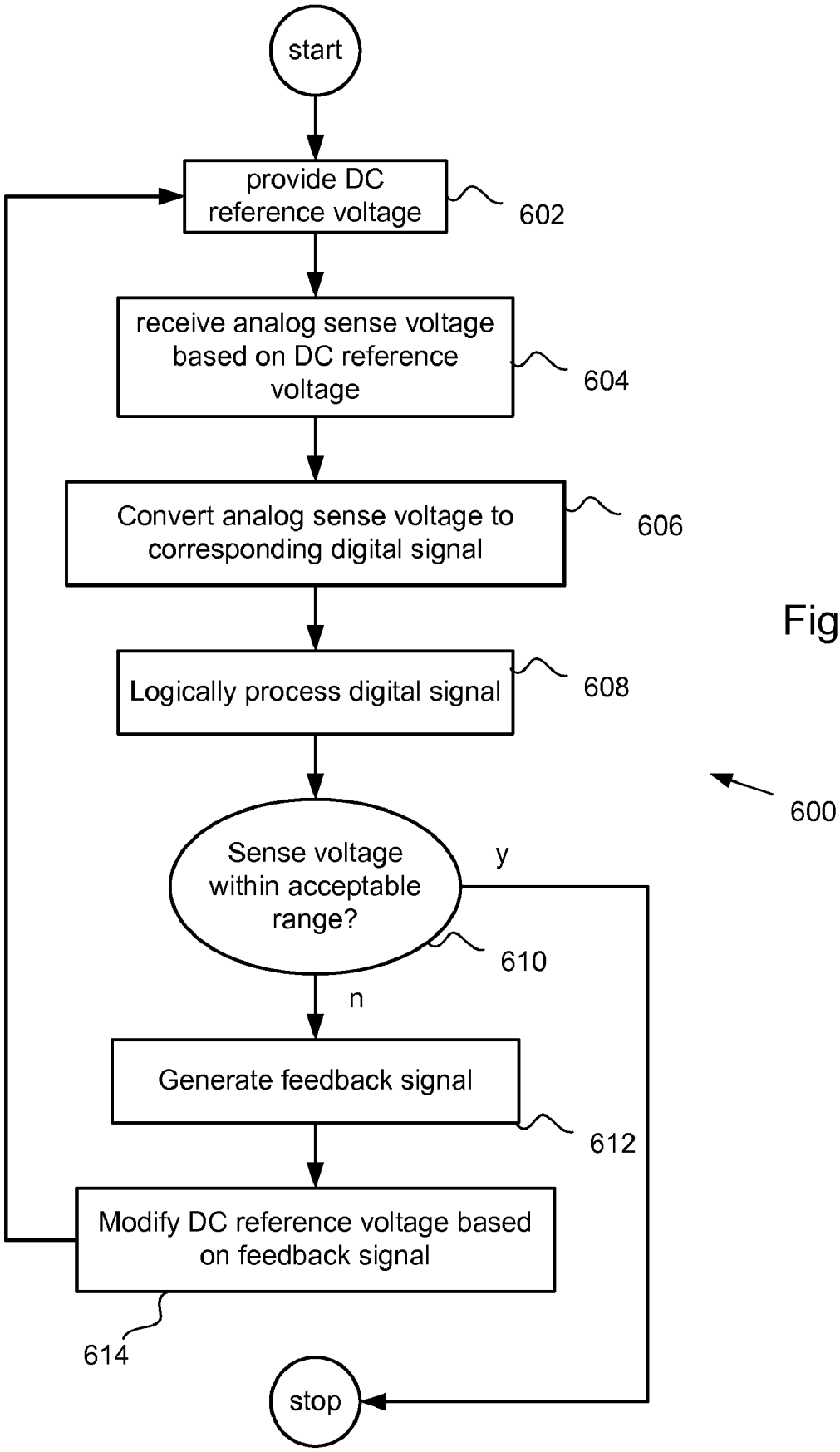
FIG. 6 illustrates a process for providing a stable and accurate DC reference voltage in accordance with the embodiments described herein.

FIG. 6 illustrates a process for providing a stable and accurate DC reference voltage in accordance with the embodiments described herein. Process 600 can be carried out by performing at least the following operations. At 602, a DC reference voltage can be provided. At 604, an analog sense voltage based upon the DC reference voltage can be received at a circuit node. In the described embodiment, the circuit node can be, for example, connected to at least one emitter of an NPN bipolar transistor. In this example, the DC reference voltage can be applied to a base node of the NPN transistor. Therefore, any variation in base-emitter voltage (i.e., $V_{BE}$) can be reflected in the analog sense voltage at the emitter node. At 606, the analog sense voltage can be converted to a corresponding digital signal. The digital signal can then be logically processed at 608 to determine if the analog sense voltage is within an acceptable range of values at 610. In one embodiment, the acceptable range of values can be those voltage values less than an upper threshold value and greater than a lower threshold value. In any case, if it is determined that the analog sense voltage is within the acceptable range, then process 600 terminates. On the other hand, if it is determined that the analog sense voltage is not within the acceptable range of values, then a feedback signal is generated at 612. The feedback signal is used to modify the DC reference voltage at 614 and control is passed back to 602. Process 600 continues until it is determined that analog sense voltage is within the acceptable range.

Figure 7:
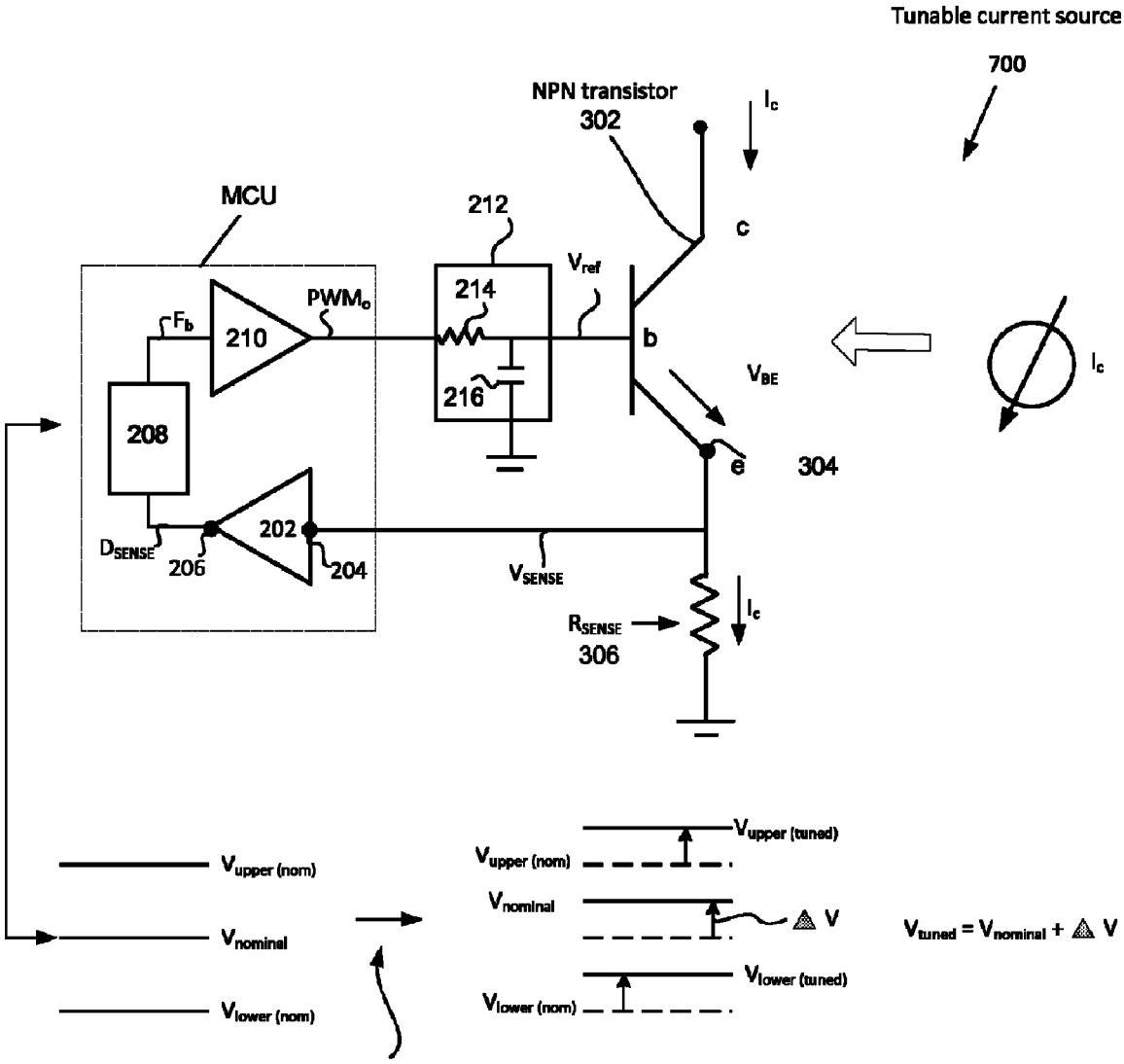
FIG. 7 illustrates another embodiment of a tunable current source.

FIG. 7 illustrates another embodiment of a tunable current source 700 that can be provided by modifying the logic by which the digital signal is processed. For example, if a nominally acceptable sense voltage value is increased/decreased by, for example ±ΔV (and assuming the upper and lower threshold values are also changed), then the sense voltage will also change according to the change in the sense voltage nominal value. The change is sense voltage will in turn modify the amount of current generated by the tunable current source in direct proportion to the resistor $R_{sense}$.

The various aspects, embodiments, implementations or features of the invention can be used separately or in any combination. The invention is preferably implemented by hardware, software or a combination of hardware and software. The software can also be embodied as computer readable code on a computer readable medium. The computer readable medium is any data storage device that can store data which can thereafter be read by a computer system. Examples of the computer readable medium include read-only memory, FLASH memory, random-access memory, CD-ROMs, DVDs, optical data storage devices. The computer readable medium can also be distributed over network-coupled computer systems so that the computer readable code is stored and executed in a distributed fashion.

While this invention has been described in terms of several preferred embodiments, there are alterations, permutations, and equivalents, which fall within the scope of this invention. It is therefore intended that the following appended claims be interpreted as including all such alterations, permutations, and equivalents as fall within the true spirit and scope of the present invention.

What is claimed is:

1. A tunable current source, comprising:

a voltage dependent current source arranged to provide a current $I_c$;

a voltage source connected to the voltage dependent current source; and a multiprocessor control unit (MCU) comprising:

an input node connected to the voltage source arranged to receive a sense voltage, an output node in communication with a control node of the voltage dependent current source, and a logic circuit coupled to the input node and the output node, wherein logical processing carried out by the logic circuit results in a control signal at the control node of the voltage dependent current source, the logical processing in accordance with a fixed predetermined relationship between the sense voltage received at the input node and a range of sense voltage values, the control signal causing the voltage dependent current source to provide the current $I_c$, wherein when the sense voltage is changed by ±ΔV, the current $I_c$ provided by the voltage dependent current source changes in direct proportion to ±ΔV.

2. The tunable current source as recited in claim 1, the MCU further comprising:

an analog to digital converter (ADC) arranged to convert the sense voltage received at the input node to a corresponding digital signal, the digital signal used as a logical input to the logic circuit, wherein the logic circuit processes at least a portion of the digital signal to provide a digital control signal.

3. The tunable current source as recited in claim 2, the MCU further comprising:

a pulse width modulation unit (PWM) having an input node coupled to the logic circuit and arranged to receive the digital control signal, the digital control signal being used by the PWM to modify a duty cycle of a PWM output signal at a PWM output node.

4. The tunable current source as recited in claim 3, further comprising:

a filter unit coupled to PWM output node arranged to perform a filtering operation on the PWM output signal, wherein the filtered PWM output signal is applied to the control node of the voltage dependent voltage source as the control signal.

5. The tunable current source as recited in claim 4, wherein the voltage dependent current source is a bipolar transistor.

6. The tunable current source as recited in claim 4, wherein the voltage source is a resistive element.

7. The tunable current source as recited in claim 6, wherein the tunable current source drives a light emitting diode (LED) circuit.

8. The tunable current source as recited in claim 7, wherein when the change in sense voltage ±ΔV results in a concomitant change in light output of the LED circuit.

9. A method for adjusting a light output LO of a light emitting diode (LED) by tuning a value of an LED current $I_{LED}$ applied at the LED, wherein the light output LO of the LED is directly related to the LED current value, the method comprising:

converting an analog sense voltage to a digital signal;

applying the digital signal at a logic circuit;

generating a control signal by logically processing the digital signal by the logic circuit, the logical processing of the digital signal in accordance with a fixed pre-determined relationship between a value of the analog sense voltage and a range of sense voltage values;

generating the LED current $I_{LED}$ by a current source in response to the control signal; and applying the LED current $I_{LED}$ to the LED, wherein when the sense voltage is changed by ±ΔV, the LED current $I_{LED}$ changes in direct proportion to ±ΔV resulting in a concomitant change in the light output LO of the LED.

10. The method as recited in claim 9, wherein the converting the analog sense voltage to the digital signal is performed by an analog to digital converter (ADC).

11. The method as recited in claim 10, wherein the logic circuit and the ADC are incorporated into a microprocessor control unit (MCU).

12. The method as recited in claim 11, the MCU further comprising:

a pulse width modulation unit (PWM) having an input node coupled to the logic circuit and arranged to receive the control signal, the control signal being used by the PWM to modify a duty cycle of a PWM output signal at a PWM output node.

13. The method as recited in claim 12, further comprising:

a filter unit coupled to PWM output node arranged to perform a filtering operation on the PWM output signal, wherein the filtered PWM output signal is applied to the control node of the voltage dependent voltage source as the control signal.

14. The method as recited in claim 11, wherein the voltage dependent current source is a bipolar transistor having an emitter node attached to a resistive element.

15. The method as recited in claim 14, wherein, wherein the LED is connected to an collector node of the bipolar transistor.

16. An apparatus for adjusting a light output LO of a light emitting diode (LED) by tuning a value of an LED current $I_{LED}$ applied at the LED, wherein the light output LO of the LED is directly related to the LED current value, the method comprising:

means for converting an analog sense voltage to a digital signal;

means for applying the digital signal at a logic circuit;

means for generating a control signal by logically processing the digital signal by the logic circuit, the logical processing of the digital signal in accordance with a fixed pre-determined relationship between a value of the analog sense voltage and a range of sense voltage values;

means for generating the LED current $I_{LED}$ by a current source in response to the control signal; and means for applying the LED current $I_{LED}$ applied to the LED, wherein when the sense voltage is changed by ±ΔV, the LED current $I_{LED}$ changes in direct proportion to ±ΔV resulting in a concomitant change in the light output LO of the LED.

17. The apparatus as recited in claim 16, wherein the converting the analog sense voltage to the digital signal is performed by an analog to digital converter (ADC).

18. The apparatus as recited in claim 17, wherein the logic circuit and the ADC are incorporated into a microprocessor control unit (MCU).

19. The apparatus as recited in claim 18, the MCU further comprising:

a pulse width modulation unit (PWM) having an input node coupled to the logic circuit and arranged to receive the control signal, the control signal being used by the PWM to modify a duty cycle of a PWM output signal at a PWM output node.

20. The apparatus as recited in claim 19, further comprising:

a filter unit coupled to PWM output node arranged to perform a filtering operation on the PWM output signal, wherein the filtered PWM output signal is applied to the control node of the voltage dependent voltage source as the control signal.

21. The apparatus as recited in claim 20, wherein the voltage dependent current source is a bipolar transistor having an emitter node attached to a resistive element.

22. The apparatus as recited in claim 21, wherein, wherein the LED is connected to an collector node of the bipolar transistor.

* * * * *